United States Patent [19]

Scafe

[11] 4,261,543

[45] Apr. 14, 1981

[54] APPARATUS FOR CONSTRUCTING CONCRETE STRUCTURES

[76] Inventor: Gayle R. Scafe, R.R. 1, Sibley, Mo. 64088

[21] Appl. No.: 115,189

[22] Filed: Jan. 25, 1980

[51] Int. Cl.[3] ..... B28B 21/06

[52] U.S. Cl. ..... 249/27; 249/210; 249/108

[58] Field of Search ..... 249/13, 18, 26, 27, 249/33, 48, 49, 50, 194, 158, 155, 219 R, 210, 108; 425/DIG. 105

[56] References Cited

U.S. PATENT DOCUMENTS

| | | | |
|---|---|---|---|
| 578,891 | 3/1897 | Moon | 249/27 |
| 3,161,703 | 12/1964 | Watson | 249/210 X |
| 3,255,990 | 6/1966 | Williams | 249/48 X |
| 3,436,052 | 4/1969 | Orampo | 249/27 |

*Primary Examiner*—J. Howard Flint, Jr.
*Attorney, Agent, or Firm*—Lowe, Kokjer, Kircher, Wharton & Bowman

[57] ABSTRACT

The present invention relates to a method and equipment for forming concrete buildings. A concrete building is presented utilizing wall form sections which are coupled with a roof form section. The roof form section comprises an elongated dome shaped section with transversely extending side sections on either side thereof. The roof form section is held in place by a hoist which is mounted on a movable trailer. By utilizing the aforedescribed form section, a concrete building may be formed utilizing a monolithic pour wherein the walls are poured followed immediately by the roof. A pivotal trough system located on top of the roof form section allows concrete to be distributed all around the roof with minimal labor.

5 Claims, 4 Drawing Figures

APPARATUS FOR CONSTRUCTING CONCRETE STRUCTURES

This invention relates generally to building construction and, more particularly, to apparatus for pouring a concrete building.

As construction costs in the building industry have risen, increasing emphasis has been placed on economical construction techniques. One of the most efficient methods of constructing buildings is from concrete. The prior art techniques have largely centered around use of concrete forms for forming basement walls. Only in a few instances has an entire building including the roof been constructed of concrete, particularly for small buildings or residential homes.

With increasing emphasis on energy efficiency, interest in underground homes has also increased. All concrete construction is recognized to be the best type of building for underground. Here again, construction of concrete walls underground does not present any particular problem because the techniques heretofore used with foundation walls are easily applied. Efforts to construct an entire underground home from concrete have been more difficult. Formation of the roof structure presents particular problems because of the need to make multiple pours and support the roof form until the concrete sets up. In many types of conventional concrete roof construction, it is also necessary to provide interior support columns for the roof after the forms are removed.

SUMMARY OF THE PRESENT INVENTION

The present invention provides a novel equipment for constructing all concrete buildings which permits wall forms and roof forms to be erected in one stage and a monolithic pour of both roof and walls to then be accomplished. The roof is of a dome shape which provides added strength and eliminates the need for interior support columns. By providing a combination of a large wall-to-wall (in one direction) dome shape roof section and a plurality of smaller roof sections, a highly efficient and structurally sound forming system is presented. The large dome shaped form section of the roof is lifted into place by a fluid actuated lifting device.

Figure 1:
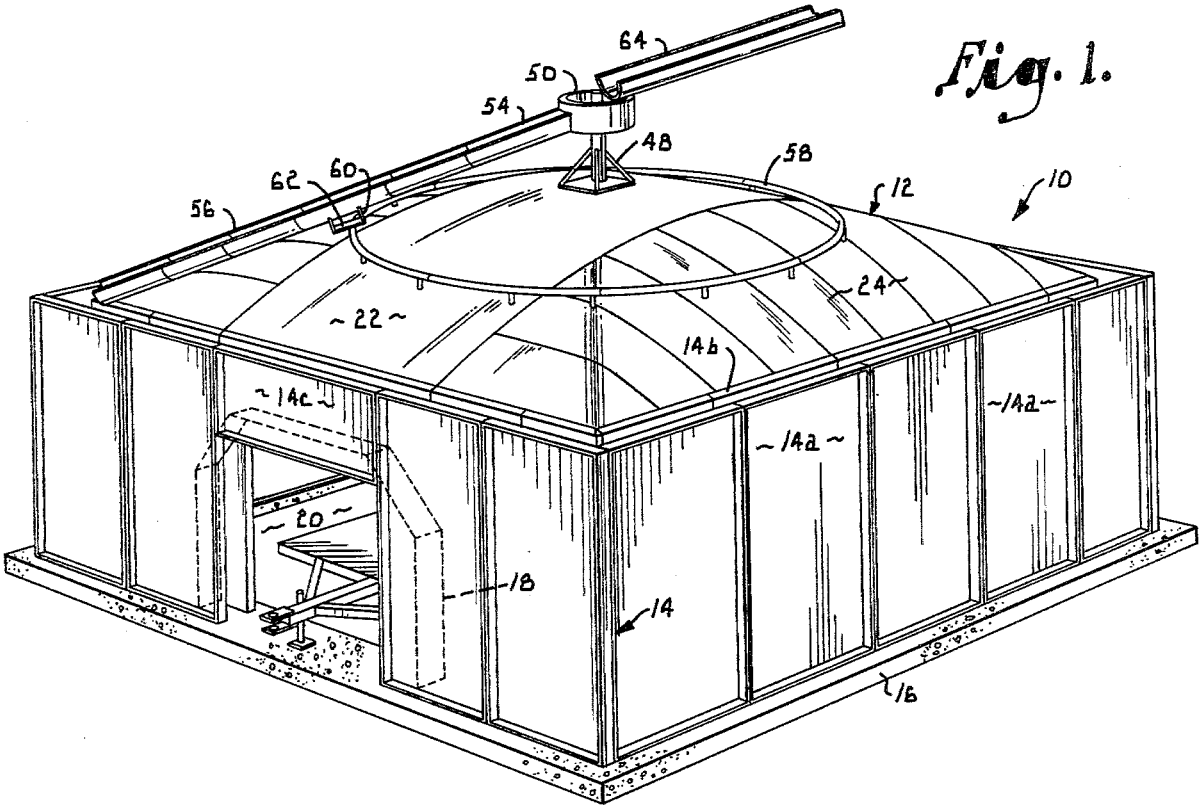
FIG. 1 is a perspective view of the building form system of the present invention in place ready for concrete to be poured.
Figure 2:
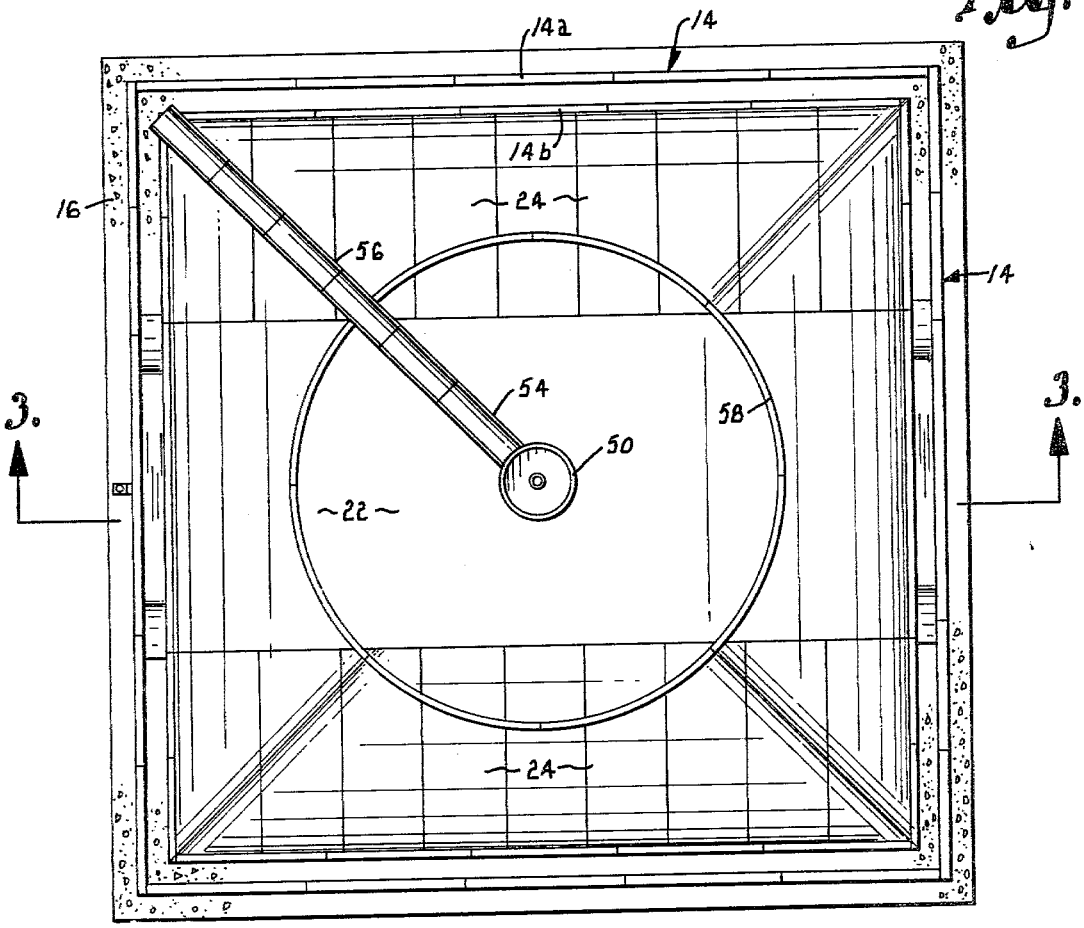
FIG. 2 is a top plan view of the building shown in FIG. 1.
Figure 3:
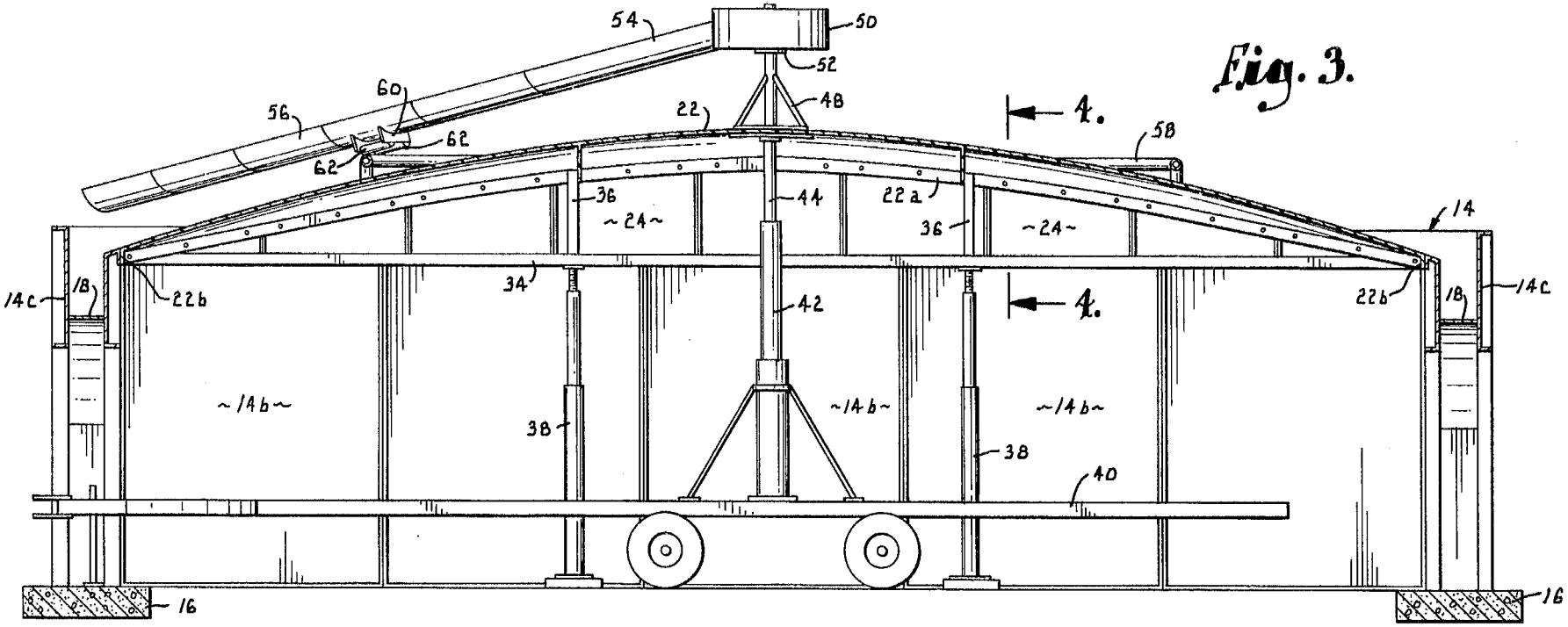
FIG. 3 is a vertical cross-sectional view taken along line 3—3 of FIG. 2.

Referring initially to FIG. 1, the outline of the building is designated generally by the numeral 10 and is presented by the forming system designated generally by the numeral 12. Forming system 12 includes wall forms 14 each of which is made up of a plurality of interconnected wall panels 14*a* disposed in interconnected relationship. A second set of wall panels designated 14*b* is disposed in spaced apart relationship to panel section 14*a* so as to complete the wall forms 14. All of the wall forms 14 are resting upon a previously poured concrete footing 16.

As illustrated in FIG. 1, one of the walls may be provided with a cutout wall panel 14*c* in conjunction with block-outs 18 to form an opening 20 into the interior of the building. Manifestly, other openings 20 may also be provided in wall forms 14 as desired.

Figure 4:
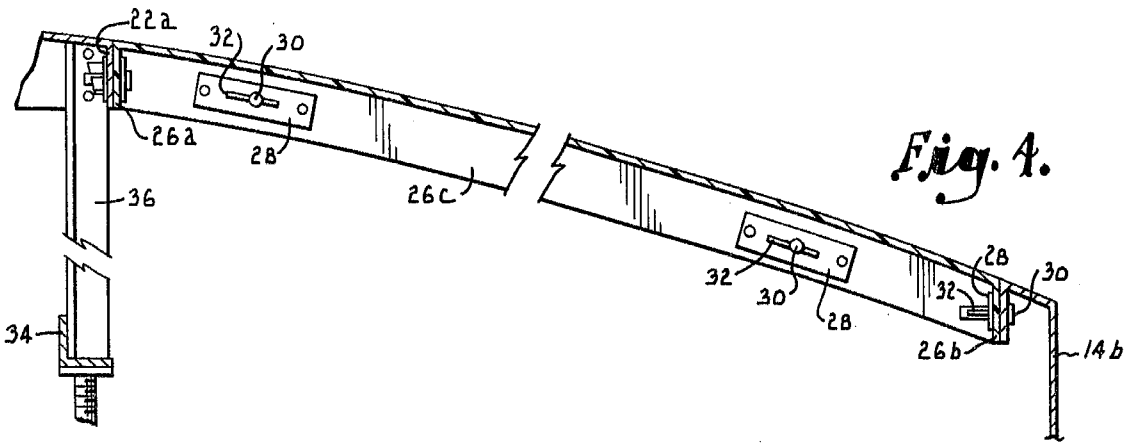
FIG. 4 is another vertical cross-sectional view, on an enlarged scale, taken along line 4—4 of FIG. 3.

The roof forming section of system 12 comprises an elongated curvilinear dome section 22 which extends from one wall 14 to the opposite wall. Dome section 22 is secured to wall forms 14 through complementary flanges which are interconnected through locking pins. As is customary with concrete building forms, a wedge is inserted through a slot in the pin to lock the pin in place. Dome section 22 is also characterized by longitudinally extending side flanges 22*a* (FIG. 4.) for purposes to be made clear hereinafter. End flanges 22*b* are provided for securing the section 22 to walls 14.

Disposed on either side of dome section 22 and extending transversly of the longitudinal axis of the latter is a plurality of side roof sections 24. Each side roof section 24 is characterized by a peripheral flange 26 having one section 26*a* in abutting relationship to the flange 22*a*, the opposite section 26*b* in abutting relationship to a complementary flange on the wall forms 14, and two longitudinally extending sections 26*c* which abut flanges 26*c* on an adjacent sections. A plurality of plates 28 are secured to the aforementioned flanges and are provided with apertures which extend through the flange sections to receive a locking pin 30. The locking pins are provided with slots to receive anchor wedges 32 as previously described.

An angle iron 34 extends parallel to the longitudinal axis of dome section 22 and receives vertical supports 36 which are coupled with dome section 22. The ends of angle iron 34 are also coupled with wall forms 14 and the angle iron is supported along its length by two stationary screw jacks 38.

A movable flat bed trailer 40 is positioned inside of the building 10 and carries a rigidly mounted hydraulic hoist 42. The end of ram 44 of hoist 42 engages a plate 46 on the underside of dome section 22 at the center of the latter. In this manner, dome section 22 is supported by the hoist.

Immediately above plate 46 is a mounting stand 48 which is rigidly secured to the plate and pivotally receives a container 50 which seats on a flange 52 integral with the stand 48. Container 50 is provided with an integral trough section 54 which forms a spout extending downwardly from the inside of the container. Trough section 54 is coupled with a plurality of additional trough sections 56 so as to complete a trough passage from container 50 to wall forms 14.

Disposed approximately halfway between wall forms 14 and container 50 is a circular track 58 which extends around the roof form. Track 58 is secured to the roof sections. One of the trough sections 56 is provided with brackets 60 on its underneath side which brackets mount rollers 62 that are designed to engage track 58.

In use, wall forms 14 are first erected and dome section 22 is placed on trailer 40 with hoist 42 in its lowermost position. The trailer 40 may then be positioned inside of the walls through one of the openings 20. The ram 44 is then extended to raise dome section 22 until the latter is coupled with the wall form sections. Side roof sections 24 are then secured in place and trough sections 54 and 56 are aligned and coupled with container 50.

the entire building may be constructed in a monolithic pour starting with the walls and working up to the roof. In FIG. 1, a delivery chute is indicated by the numeral 64 and this chute would normally be from a belt conveyor or a ready mix concrete truck. Chute 64 delivers concrete to container 50 and the concrete travels down the trough presented by sections 54 and 56 to the far corners of the roof. As the corners are filled, the lowest trough section is removed so as to deliver the concrete farther up the roof. This process is continued and trough sections 56 are one by one removed until the top center of dome section 22 is reached. The trough is easily moved over the entire rough area as a result of rollers 62 and track 58.

The form system of the present invention allows for more efficient and economical construction of concrete buildings. The novel roof forming system provides a plurality of interlocking panels which are extremely effective in distributing stresses toward the walls so as to minimize the need for interior support. Utilizing the system of the present invention, once the concrete has adequately cured, hoist 42 as well as jacks 38 may be removed thereby leaving the interior free of any vertical columns.

The exact configuration of the building including all dimensions and the size of openings 20 may, of course, be varied in accordance with the requirements of a particular job.

I claim:

1. A form system for a building comprising:

an elongated dome shaped roof section extending from one side of the building to the opposite side;

a plurality of side roof sections having their longitudinal axes transverse to the longitudinal axis of said dome roof section, said side sections being disposed on opposite sides of said dome roof section along the length of the latter;

means for coupling said dome roof section with said side roof sections; and means for coupling each of said side roof sections with an adjacent side roof section disposed on the same side of said dome roof section.

2. The invention of claim 1, wherein is included a plurality of wall forms coupled with said side sections and said roof section.

3. The invention of claim 2, wherein is included track means adapted to be disposed in a circle on said dome roof section and said side roof sections; pivot support means disposed at the center of said circle; and trough means supported for movement along said track means and on said pivot means, said trough means being adapted to receive concrete and carry it to said wall forms.

4. The invention of claim 3, wherein is included means for supporting said dome roof section and said side roof sections.

5. The invention of claim 4, wherein said supporting means includes a fluid cylinder lifting device adapted to be disposed at the center of said dome roof section and movable carrier means for said lifting device.

* * * * *